US005590631A

United States Patent [19]

Tuckey

[11] Patent Number: 5,590,631

[45] Date of Patent: Jan. 7, 1997

[54] FUEL SYSTEM ACCUMULATOR

[75] Inventor: Charles H. Tuckey, Cass City, Mich.

[73] Assignee: Walbro Corporation, Cass City, Mich.

[21] Appl. No.: 426,259

[22] Filed: Apr. 21, 1995

Related U.S. Application Data

[63] Continuation-in-part of Ser. No. 398,215, Mar. 2, 1995, Pat. No. 5,579,739, which is a continuation-in-part of Ser. No. 262,847, Jun. 21, 1994, Pat. No. 5,398,655, which is a continuation-in-part of Ser. No. 181,848, Jan. 14, 1994, Pat. No. 5,458,104.

[51] Int. Cl.[6] ..... F02M 7/00

[52] U.S. Cl. ..... 123/447; 123/456

[58] Field of Search ..... 123/506, 447, 123/497, 456, 514

[56] References Cited

U.S. PATENT DOCUMENTS

| | | | |
|---|---|---|---|
| 4,248,194 | 2/1981 | Drutchas | 123/497 |
| 4,627,463 | 12/1986 | Johnstone . | |
| 4,747,388 | 5/1988 | Tuckey | 123/514 |
| 4,800,859 | 1/1989 | Sagisaka | 123/463 |
| 4,951,636 | 8/1990 | Tuckey et al. . | |
| 5,133,323 | 7/1992 | Treusch | 123/497 |
| 5,148,792 | 9/1992 | Tuckey | 123/497 |
| 5,220,941 | 6/1993 | Tuckey . | |
| 5,265,644 | 11/1993 | Tuckey | 137/510 |
| 5,289,810 | 3/1994 | Bauer | 123/510 |
| 5,337,718 | 8/1994 | Tuckey | 123/497 |
| 5,361,742 | 11/1994 | Briggs | 123/497 |
| 5,398,655 | 3/1995 | Tuckey | 123/497 |

*Primary Examiner*—C. S. Miller

*Attorney, Agent, or Firm*—Barnes, Kisselle, Raisch, Choate, Whittemore & Hulbert

[57] ABSTRACT

An accumulator for a no-return fuel system for a vehicle engine with fuel injectors. The accumulator has a housing with a flexible diaphragm between first and second chambers and a spring in one chamber yieldably closing the diaphragm to reduce the volume of the other chamber. One chamber has a fuel inlet that allows fuel into the chamber which accommodates expansion of the fuel by increasing the volume of the chamber against the bias of the spring. Preferably, the diaphragm has an over-pressure valve which opens when the system has reached its maximum over-pressure to allow the fuel to flow from one chamber to the other chamber in bypass relation to the injectors. The other chamber has an outlet communicating directly with the fuel tank. In another embodiment, the accumulator has a housing with a flexible diaphragm between first and second chambers in which one chamber has a fuel inlet for communication with the fuel rail and the other chamber continuously communicates with the engine air intake manifold so that the pressure drop across the engine fuel injectors is maintained more constant as the manifold pressure varies.

27 Claims, 2 Drawing Sheets

FUEL SYSTEM ACCUMULATOR

This is a continuation-in-part of U.S. patent application Ser. No. 08/398,215, filed Mar. 2, 1995, now U.S. Pat. No. 5,579,739 issued Dec. 3, 1996, which is a continuation-in-part of U.S. patent application, Ser. No. 08/262,847, filed Jun. 21, 1994, now U.S. Pat. No. 5,398,655, issued Mar. 21, 1995, which was a continuation-in-part of U.S. patent application, Ser. No. 08/181,848, filed Jan. 14, 1994, now U.S. Pat. No. 5,458,104, issued Oct. 17, 1995.

FIELD OF THE INVENTION

This invention relates to automotive fuel systems and more particularly to an accumulator to accommodate expansion of fuel.

BACKGROUND AND FEATURES OF THE INVENTION

In many engines with fuel injection systems, it is desirable to supply liquid fuel to the injector or injectors at a pressure which varies as a function of the intake manifold pressure so that the pressure drop across the injectors remains constant. The manifold pressure and the flow rate of fuel supplied by the injectors to the engine each vary with engine speed, load and other operating conditions.

Previous fuel supply systems have been developed, one of which is shown and described in U.S. Pat. No. 5,148,792. This system has a fuel tank with a fuel pump to supply fuel under pressure through a fuel line to a fuel rail coupled to a fuel injector for supplying fuel to the engine cylinder. The pump includes a pressure sensor which provides an electrical signal as a function of fuel pressure at the pump outlet to an electronic control to vary the speed of the pump to deliver fuel to the engine as required by engine demand.

Previous systems have been known to include a pressure regulator which has a manifold reference to maintain a constant pressure drop across the injectors. One such regulator is disclosed in U.S. Pat. No. 5,265,644. However, these prior regulators cannot accommodate any increase in pressure caused by fuel expansion due to heat rise and do not accumulate the increased volume of the heated fuel. For example, during engine deceleration the injectors may close trapping fuel in the fuel rail. The high temperature of the fuel rail causes the fuel to be heated and expand which increases the pressure in the fuel rail.

Pressure rise and fuel expansion in the rail also occurs during conditions known as hot soak. Hot soak conditions occur when the engine has been idling or running at slow speeds especially during hot weather or when the hot engine is turned off. The high temperature in the fuel rail plus the hot ambient air causes the fuel trapped in the fuel rail to be heated and expand. Some pressure increase is desirable to prevent fuel vapor formation. However, excessive pressure in the fuel rail is undesirable since it could force fuel through the injectors causing leakage and/or malfunctions.

In bypass type regulators, any fuel pressure above the set system pressure is relieved by returning fuel to the tank through a fuel return line. Accordingly, these devices maintain only a set maximum system pressure. In addition, the bypassed fuel may have an elevated temperature which may cause unwanted vaporization.

OBJECTS OF THE INVENTION

Accordingly, among the objects, features and advantages of this invention are to provide an accumulator for a no-return fuel system which accumulates heated expanded fuel in the fuel rail, dampens pressure pulses produced by the pump, decreases engine emissions, relieves excessive pressure of the heated expanded fuel, and/or maintains a constant fuel pressure drop across the injectors in response to varying normal engine operating conditions; and which is rugged, durable, maintenance free, and of relatively simple design, economical manufacture and assembly, and in service has a long useful life.

SUMMARY OF THE INVENTION

One or more of the foregoing objects are achieved in accordance with the invention by providing an accumulator for a no-return fuel system to accommodate expansion due to heating of fuel in the fuel rail and to accommodate and maintain increased pressure of heated fuel in the fuel rail to prevent vapor formation during deceleration or engine shutdown when the injectors are not functioning. The accumulator may also provide an over-pressure relief to bleed fuel back into the tank when it has reached its maximum accumulating capacity.

Preferably, in one embodiment the accumulator is mounted on the fuel rail for communication with the fuel delivery line and is referenced to the engine intake manifold and provides an expansion chamber to accommodate any increase in fuel volume. The accumulator has a diaphragm received between a first chamber and a second liquid fuel expansion chamber continuously communicating with the fuel rail. Liquid fuel is supplied at a constant pressure by a pump to the fuel rail. If the fuel in the rail is heated and expands during deceleration or shut down, the diaphragm is displaced to increase the volume of the second chamber to accommodate expansion of the heated fuel.

Preferably, in another embodiment the accumulator also functions as a system pressure relief bypass valve and is mounted in the fuel tank. The diaphragm has a normally closed valve which, when opened, communicates the second liquid fuel chamber with the first chamber and thus the tank. This valve opens in response to any overpressure that may develop to bypass fuel from the second chamber into the first chamber and thence into the fuel tank.

In another embodiment of the accumulator/bypass relief valve unit, the accumulator either eliminates or greatly reduces fuel bypass by providing an electric switch that slows the pump and thus the flow of fuel to the fuel rail when the expansion chamber reaches its maximum capacity but before the valve opens to bypass fuel from the first chamber to the second chamber.

BRIEF DESCRIPTION OF THE DRAWINGS

These and other objects, features, and advantages of this invention will be apparent in view of the following detailed description of the best mode, appended claims and accompanying drawings in which:

DETAILED DESCRIPTION

Figure 1:
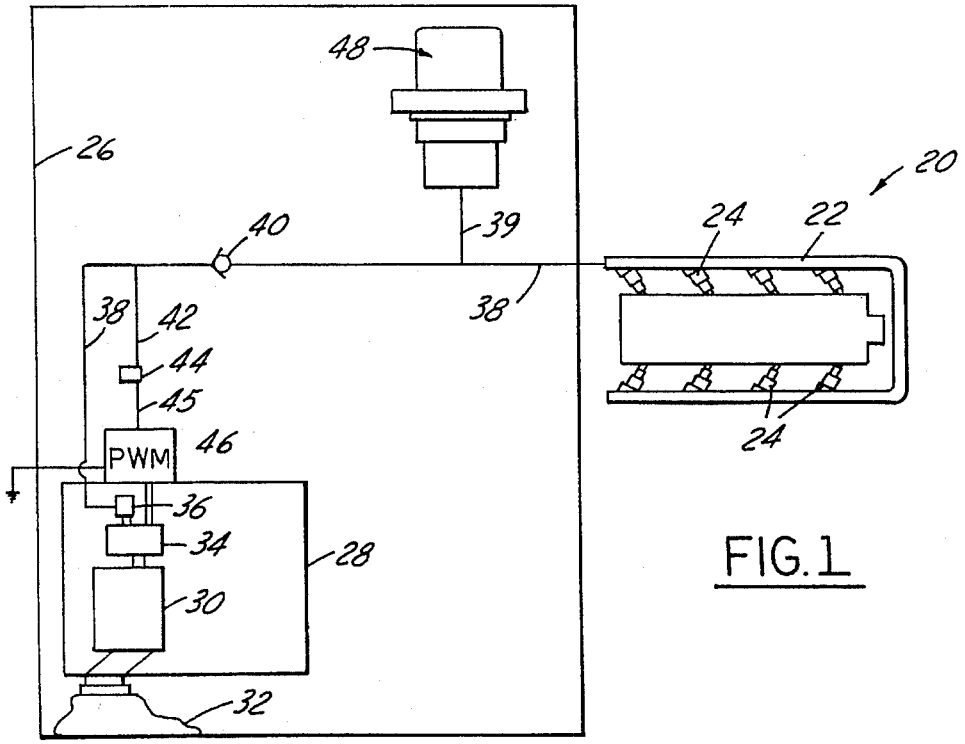
FIG. 1 is a schematic view of a fuel supply system for an internal combustion engine Which employs a first embodiment of an accumulator/bypass relief valve unit embodying this invention.

FIG. 1 illustrates a fuel supply system with a first embodiment of an accumulator/bypass relief valve unit embodying this invention for delivery of fuel to an internal combustion engine 20 having a fuel rail 22 and fuel injectors 24. A fuel tank 26 houses a fuel reservoir canister 28 and a pump 30 with an inlet having a filter 32 and driven by a motor 34 to pump fuel to a fuel manifold 36 and thence through an outlet to a fuel supply line 38 with an incorporated coaxial check valve 40 preventing fuel line back flow. Preferably the electric pump 30/34 is arranged in canister 28 in accordance with U.S. Pat. No. 4,747,388 the disclosure which is incorporated herein by reference.

Upstream of the check valve 40 is a side passage 42 leading to a pressure control unit which has a set point higher than the desired system pressure and incorporates a pressure sensor 44 exposed to pressurized fuel in passage 42. Sensor 44 is in a circuit via leads 45 with a pulse width modulator 46 controlling the pump 30. The pump speed is varied to produce a substantially constant output pressure under varying engine demand conditions. The pump 30 is driven by the electric motor 34, the speed of which is controlled by the pulse width modulator 46 in a manner described in detail in U.S. Pat. No. 5,148,792 the disclosure of which is incorporated herein by reference. In the returnless fuel supply system shown in FIG. 1, the system attempts to maintain a desired substantially constant output fuel pressure by changing the speed of the pump as a result of varying fuel demand. For example, if the fuel demand decreases, the pulse width modulator senses the increase in pressure of fuel in the line 38 and slows the pump to supply less fuel and decrease fuel pressure.

The first embodiment of an accumulator/bypass relief valve unit 48 is connected to the fuel line 38 downstream of check valve 40 and communicates via line 38 with fuel rail 22. Accumulator 48 accumulates expanded fuel in the fuel line and rail and limits the maximum over-pressure of the expanded fuel. This is accomplished by connecting an expansion chamber of the accumulator with the fuel line and rail so that any expansion of fuel in the fuel line and rail or pressure change therein is transmitted thereto.

Accumulator 48 (FIG. 2) has a body 50 and a cap 52 which form a housing that encloses a diaphragm 54. The housing and the diaphragm 54 define a fuel accumulation expansion chamber 56 and a bypass chamber 58. Cap 52 is secured to the body by a flange 62 with a return bend 64 rolled around body 50 during assembly of the components.

Diaphragm 54 has a relatively thin and flexible central portion 66 and a circumferentially continuous peripheral rib 68 received in a groove 70 in the body and retained therein by the cap to provide fluid tight seals between them and the diaphragm. Preferably, to permit full travel or displacement of the diaphragm, it has a circumferentially continuous annular pleat or bellows 72 sized to permit by gathering and ungathering thereof full working travel (as viewed in FIG. 2) of the diaphragm central portion 66 in cap 52 between the travel end limit positions illustrated in FIG. 2 in solid lines (minimum volume of chamber 56) and phantom lines (maximum volume of chamber 56). Preferably, the diaphragm is made of a flexible elastomer such as a fluorosilicone rubber or preferably an acrylonitrile butadiene rubber and may be reinforced with a fabric embedded in the elastomer. The diaphragm is yieldably biased toward body 50 by a compression coil spring 74 disposed in chamber 58 and bearing at its upper end on cap 52 and with its end coil retained thereon by an annular cap shoulder 76. The lower end coil of spring 74 bears against a retainer/presser cup 78 which has an upturned cylindrical wall 80 spaced radially inwardly of the cylindrical side wall 81 of cap 52 to accommodate bellows 72.

Liquid fuel is admitted to chamber 56 through an inlet passage 82 in the body connected by a branch line 39 (FIG. 1) to fuel line 38. A fuel bypass pressure relief valve 83 is carried on the diaphragm for travel therewith and is normally closed against the diaphragm by a spring 84 which acts between the bottom wall of presser cap 78 and a retainer cap 86 secured to a valve stem 87 that is connected to a head 88 of valve 83. Stem 87 extends through a central opening 77 in diaphragm portion 66 and a registering opening 89 in the cup bottom wall.

Valve 83 normally seals the diaphragm opening 77 and forms part of its working surface as diaphragm 54 is displaced within cap 52 by fuel pressure within expansion chamber 56 acting on the working surface of the diaphragm and valve. Fuel bypass pressure relief occurs only when valve 83 is opened by engagement of the upper end of valve stem 87 with end wall 89 of cap 52, thereby stopping upward motion of valve 83 as upward travel of the diaphragm continues. This relative motion between the valve 83 and the diaphragm opens the valve and thereupon allows fuel to flow from accumulator chamber 56 around the valve and into relief chamber 58 and thence out through outlet 90 and back into the fuel tank 26. While valve 83 is open, check valve 40 is closed, and expanded fuel may flow into the accumulator chamber 56 from the fuel rail 22 through line 38.

Figure 2:
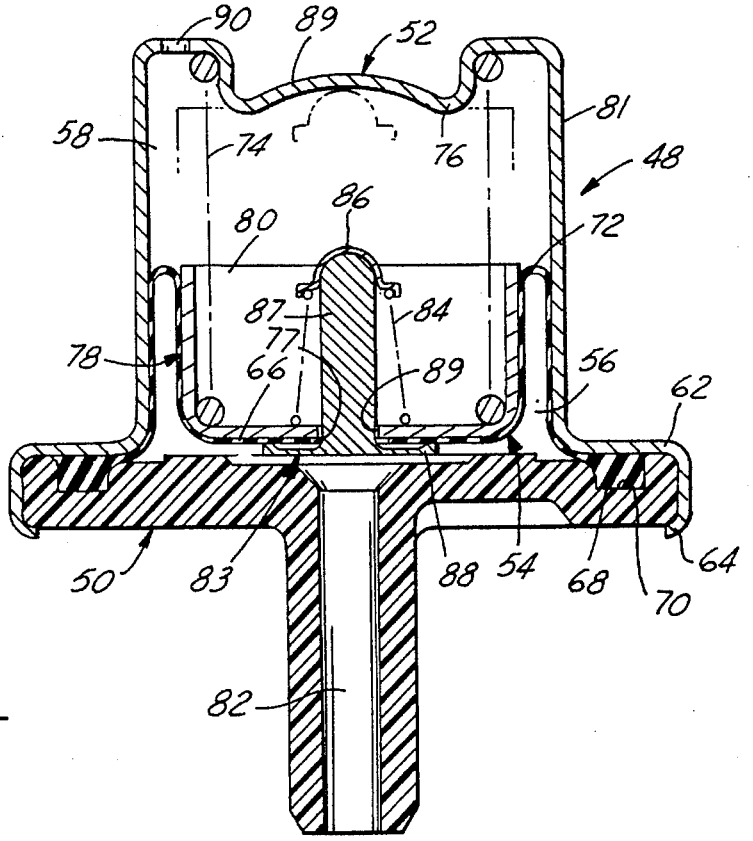
FIG. 2 is an enlarged vertical center cross-sectional view of the first embodiment accumulator bypass relief valve of FIG. 1 shown by itself.

In use, if the engine is operating under a constant fuel flow rate to the rail and within normal operating fuel pressure range, the force of spring 74 acting on diaphragm 54 biases it toward accumulator body 50, and valve 83 is biased to a closed position by spring 84 as seen in FIG. 2. Under certain conditions, such as engine deceleration or hot soak, the volume of fuel trapped in the rail 22 (by the closing of check valve 40) may increase due to continued pump output or it may be heated sufficiently to expand its volume. As the volume of fuel so increases, it flows through the inlet passage 82 into the expansion chamber 56. As the fuel enters the chamber 56, it causes the volume of chamber 56 to expand by the fuel under pressure therein moving diaphragm 54 to travel upwardly on its expansion working stroke in housing cap 52 ensmalling chamber 58 and enlarging chamber 56, against the force of spring 74 to thereby accumulate the expanded fuel in chamber 56. Once the diaphragm is displaced from its lowermost position, spring 74 establishes system pressure, which is a function of the force of spring 74 and the working area of the diaphragm.

The volume of chamber 56 can continue to expand until valve 83 is opened during the last increment of upward diaphragm travel as it approaches the upper travel limit of cup 78 (phantom line position in FIG. 2). This establishes the maximum volume of the chamber 56 and sets the maximum system pressure. The maximum volume of chamber 56 is thus reached when valve stem 87 abuts wall 89 of cap 52. Valve 83 normally remains closed by fuel pressure in chamber 56 throughout its remaining travel within cup 78 before reaching this bypass relief position. However, if any fuel rail overpressure develops sufficient force on diaphragm 54 acting against the resistance force of spring 84 as well as spring 74 to thereby move the diaphragm further toward its upper travel limit, this lost motion travel between the diaphragm and valve 83 will thereby open valve 83 and thus allow fuel in chamber 56 to flow past valve head 88 and via openings 77, 89 into chamber 58, and thence via cap outlet 90 and back into tank 26. As the volume of chamber 56 decreases by such relieving of fuel via openings 77, 89 to chamber 58, diaphragm 54 is biased by spring 74 to move downwardly away from the cap end wall 89, thereby allowing the motion of stem 87 relative to cup 78 to close valve 83.

Thus, the pressure of the fuel in chamber 56 and hence line 38 and the fuel rail 22 is maintained by spring 74. This mode of operation is advantageous because the spring force can be selected to be higher than the normal system operating pressure which keeps the fuel pressurized above its vaporization pressure and hence in a liquid state throughout the maximum temperature range normally encountered in use.

Figure 3:
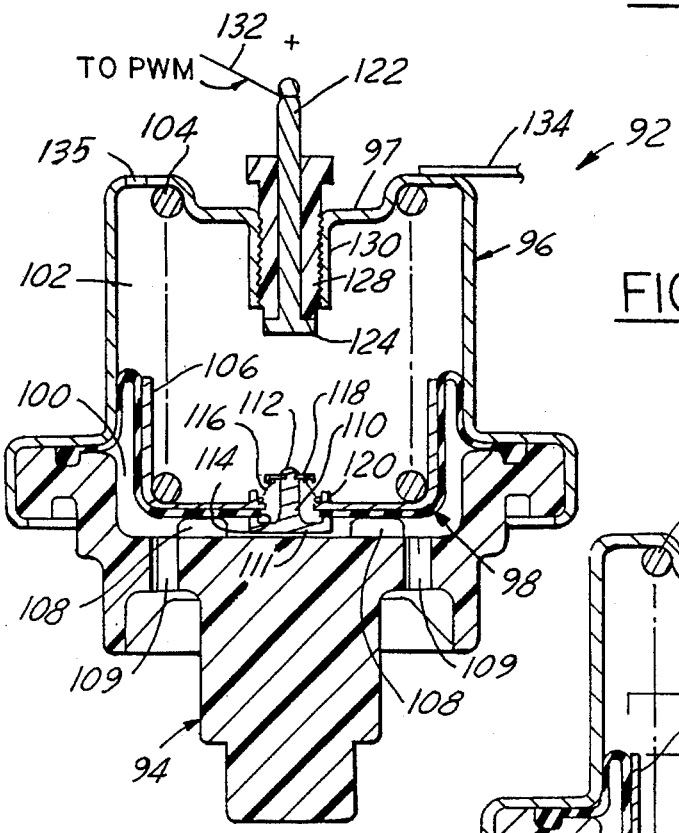
FIG. 3 is an enlarged cross-sectional view of second embodiment of an accumulator/bypass relief valve unit useable in the system of FIG. 1 but shown by itself.

As shown in FIG. 3, a second embodiment of an accumulator 92 incorporates a control switch that, when closed, provides an electrical control signal to slow pump 30 and thus reduce the delivery line fuel pressure to thereby eliminate or greatly reduce the quantity of fuel bypassed by valve 83. Accumulator 92 has a body 94 and a cap 96 that forms a housing enclosing a diaphragm 98 forming with the housing a fuel expansion chamber 100 and a bypass chamber 102. The diaphragm is biased by a coil spring 104 acting between cap 96 and a retainer/presser cup 106 resting on the central portion of the diaphragm. At normal system operating pressures the spring causes the diaphragm central portion to rest on a circular row of dimples 108 on body 94 which prevent body inlets 109 from being covered by the diaphragm.

To bypass fuel from expansion chamber 100 to chamber 102, a T-shape head 111 of an electrically conductive metallic valve 110 is provided on the expansion chamber side of the diaphragm. Valve 110 has a relatively short valve stem 112 extending from head 111 through central openings 114, 115 in the diaphragm and retainer cup. Valve 110 is biased to its closed position by a spring 116 received between a spring retainer cap 118 on stem 112 and an abutment ring 120 on the bottom wall of retainer cup 106.

In the second embodiment, expansion chamber 100 accommodates expanded fuel in much the same manner as accumulator 48 of the previously described embodiment. However, accumulator 92 of FIG. 3 is also operable to generate a control signal for pulse width modulator 46 when expansion chamber 100 has substantially reached its maximum volume to thereby slow pump 30, 34 and thus simultaneously reduce the amount of fuel supplied to the rail.

This is achieved by providing an electric switch in the form of a metal rod 122 having an end contact 124 and mounted to extend through an opening in a plastic threaded screw 128, such as by a press fit. The screw is threaded into an internally threaded downturned annular neck portion 130 of the end wall 97 of cap 96. The free end of the metal rod 122 extends above the plastic screw to be electrically connected to the pulse width modulator by an electrical control lead 132. The metal cap wall 97 is energized through another control lead 134 of the switch control circuit so that when the volume of expansion chamber 100 reaches its maximum, the metal valve stem 112 abuts contact 124 of the metal rod 122 to thereby close the electric circuit. Control current is then transmitted from lead 134 through the switch electrically conductive path comprising metal cap 97, spring 104, the bottom wall of metal cup 106, spring 116, metal cap 118 and valve stem 112 to the metal rod 122, and thence via lead 132 to the pulse width modulator.

In operation, during hot soak conditions, fuel from line 38 and rail 22 expands into chamber 100 through ports 109, causing upward movement of cup 106 with like movement of diaphragm 98. Chamber 100 thus expands until valve stem 112 abuts contact 124 of rod 122 to complete the electrical control circuit and thereby generate a signal to cause the pulse width modulator 46 to slow down pump 30 and thus the supply of fuel to fuel rail 22 via line 38. Screw 128 can be advanced or retracted to adjust the gap between contact 124 and valve stem 112 for changing the upper limit of the volume of expansion chamber 100. This adjustment thus varies the relief pressure at which the valve 110 opens and the slightly lower pressure at which the pump is slowed by the switch control circuit of PWM 46.

Due to this pump control feature, valve 110 is preferably prevented from opening, in order to reduce the quantity of fuel bypassed, by so decreasing the amount of fuel supplied to the rail. However, any excessive overpressure caused by continued injector closure during engine deceleration or by heated fuel at shut down, causes displacement of the diaphragm 98 relative to the valve 110 to thereby open the valve in the manner similar to that described with reference to the accumulator of FIG. 2. The excessive-pressure relieving incremental volume of fuel is then bypassed through openings 114, 115 into chamber 102 and through a cap outlet 135 back into the fuel tank 26.

Figure 4:
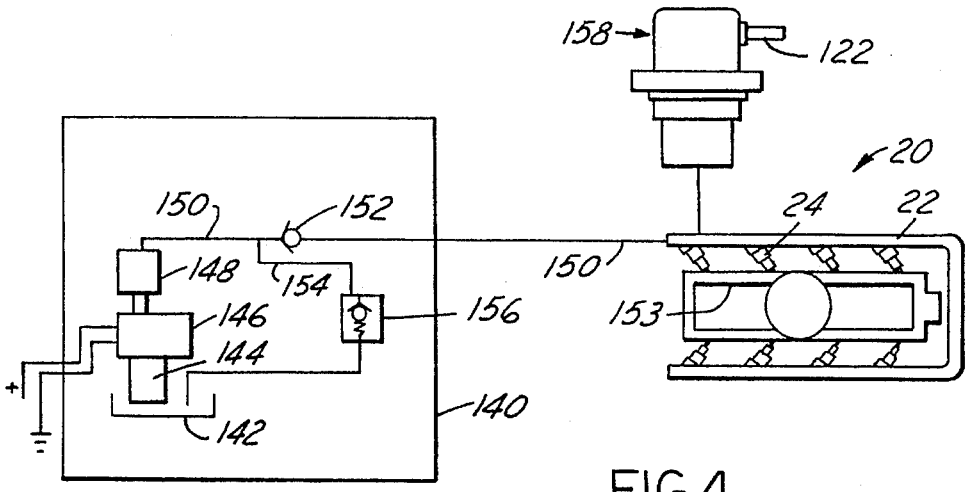
FIG. 4 is a schematic view of another fuel supply system for an internal combustion engine which employs a third embodiment of an accumulator embodying this invention.
Figure 5:
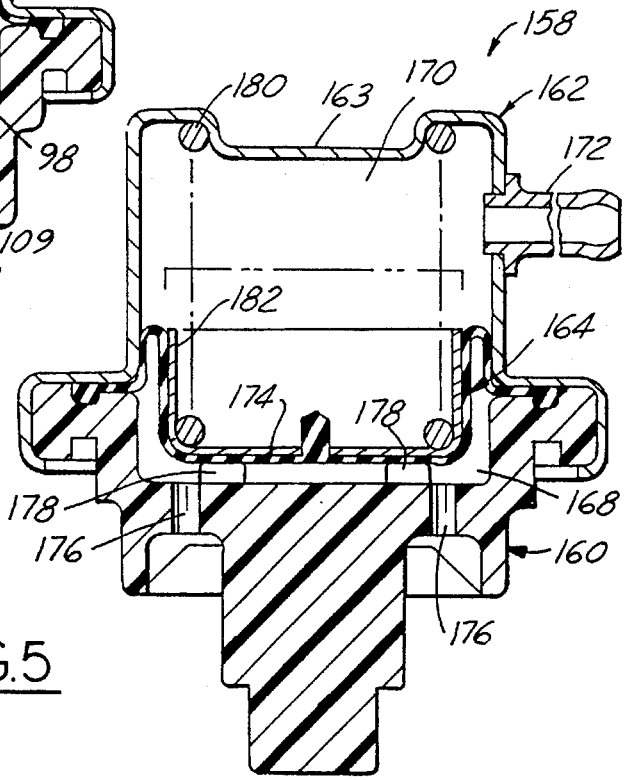
FIG. 5 is an enlarged vertical center cross-sectional view of the accumulator of FIG. 4 shown by itself.

A third embodiment of an accumulator 158 of the invention, as incorporated in another delivery fuel system, is shown in FIGS. 4 and 5. Accumulator 158 is mounted directly on fuel rail 22 (or closely adjacent thereto) to provide an easy manifold reference. Fuel is delivered to fuel rail 22 from a fuel tank 140 having a canister reservoir 142 with a pump 144 driven by an electric motor 146 to deliver fuel to a fuel pump manifold 148 and thence to a fuel supply line 150. A one-way check valve 152 in line 150 allows fuel flow to fuel rail 22 but not in a reverse direction. A side passage 154 is connected upstream of check valve 152 and has a relief bypass valve 156 to deliver excessive fuel back to the reservoir. Accumulator 158 is thus connected to fuel rail 22 outside of tank 140.

As best seen in FIG. 5, accumulator 158 comprises a body 160 and a closed cap 162 which together define a housing that encloses a diaphragm 164 secured thereto in the same manner as in accumulator 48 of the embodiment in FIG. 2. The diaphragm along with the housing forms a fuel expansion chamber 168 and an opposed sealed gas chamber 170 on the other side of the diaphragm. Cap 162 has a passage or tube 172 communicating with gas chamber 170 at one end and connected at its other end to the engine intake manifold 153.

Diaphragm 164 is formed similar to the diaphragm 54 of the embodiment of FIG. 2 except that the central portion 174 is continuous and imperforate so that there is no communication between fuel expansion chamber 168 and gas chamber 170. Liquid fuel is admitted from rail 22 and line 150 to chamber 168 through inlet passages 176 in the body. The body has a plurality of raised dimples 178 to provide a seat for the diaphragm 176 so that it does not cover the inlet passages 176 when the diaphragm is at rest thereon as shown in the position of FIG. 5.

In normal operation, accumulator 158 maintains and varies the pressure in the fuel rail to provide a substantially constant pressure drop across the fuel injector 24. This is accomplished by applying the manifold pressure to chamber 170 through tube 172 and by the force of spring 180 acting via presser cup 182 on the diaphragm and on the fuel in chamber 168. Since chamber 168 is in constant communication with the fuel rail through ports 176, any pressure change in the rail is transmitted to chamber 168.

When the system is at rest, diaphragm 174 is biased by the spring 180 to the position of FIG. 5.

During engine deceleration or hot soak conditions, the fuel trapped in the rail 22 may expand its contained volume as previously described. As the fuel volume tends to increase in rail 22 and/or line 150 the incremental fuel volume increase is accumulated in expansion chamber 168 through ports 176. Expansion chamber 168 thus acts to maintain the increased volume of expanded fuel contained under pressure, thereby decreasing the likelihood of flashing, i.e., the formation of fuel vapor in the rail and/or delivery line. The volume of the expansion chamber 168 can increase until the spring retainer cup 182 tops out by abutting the end wall 163 of cap 162. This establishes the maximum volume of the expansion chamber.

By communicating engine intake manifold pressure to cap spring chamber 170, the net biasing force acting on diaphragm 164 to pressurize fuel in chamber 168 is desirably modulated in a direction tending to produce a more constant fuel pressure drop across the injectors. That is, as manifold pressure drops, the gas biasing force on the diaphragm also drops, thereby also reducing diaphragm developed fuel line pressure delivered at the injectors, and vice versa.

I claim:

1. An accumulator for an automotive fuel delivery system for an engine having an air intake manifold and at least one fuel injector operably associated therewith and a fuel pump for supplying tank fuel to the injector, said accumulator comprising a housing, a flexible diaphragm defining in cooperation with said housing first and second chambers impermeably separated by said diaphragm, said diaphragm having a circumferentially continuous annular pleat portion surrounding a central portion of the diaphragm and sized to permit by gathering and ungathering thereof a predetermined full working travel of said diaphragm central portion in said chambers within said pleat portion, a spring in said second chamber and acting between said housing and said diaphragm central portion for yieldably biasing said diaphragm to resist that working travel of said diaphragm decreasing the volume of said second chamber, said housing having a reference port on one side of said diaphragm adapted for continuously communicating a source of reference air pressure related to operation of the engine with said second chamber for controlling the biasing force of said spring on said diaphragm, said housing having a fuel passage on the opposite side of said diaphragm having an inlet to said first chamber adapted for continuously communicating said first chamber with the fuel delivery system such that any volumetric increase in the fuel in the system between the fuel injector and said fuel passage inlet is accommodated within limits by that working travel of said diaphragm causing expansion of said first chamber against the biasing force of said spring, said spring acting against said diaphragm being operable during such first chamber expansion to cause an increase in the pressure of the fuel in the system communicating with said first chamber as modulated by the reference air pressure communicated via said port to said second chamber.

2. A no-return fuel delivery system for an internal combustion engine having a fuel rail, an air intake manifold and at least one fuel injector, said fuel delivery system comprising a fuel supply, a fuel pump, a motor connected to said fuel pump for driving said fuel pump, said fuel pump having an outlet connected via a fuel delivery line and a one-way check valve therein to the fuel rail, and an accumulator in communication with said outlet downstream of said check valve, said accumulator comprising a housing, a flexible diaphragm defining in cooperation with said housing first and second chambers said diaphragm having a circumferentially continuous annular pleat portion surrounding a central portion of the diaphragm and sized to permit by gathering and ungathering thereof a predetermined full working travel of said diaphragm central portion in said chambers within said pleat portion, and biasing means in said housing for yieldably forcing said diaphragm into volume diminishing cooperation with said first chamber, said housing having a fuel passage continuously communicating said first chamber with the fuel rail so that when fuel trapped between the fuel rail and said check valve expands into said first chamber working travel of said diaphragm moves said diaphragm away from said fuel passage to enlarge the volume of said first chamber to accommodate an expanded volume of fuel and maintain the trapped volume of fuel under pressure by the force of said biasing means acting on said diaphragm.

3. The fuel delivery system of claim 2 wherein said diaphragm has a fuel delivery system bypass valve carried by said diaphragm and movable relative to said diaphragm to open and closed positions when diaphragm travel approaches first chamber maximum volume to thereby communicate fuel between said first chamber and said second chamber for relieving system pressure above a predetermined maximum set point.

4. The fuel delivery system of claim 3 wherein said housing has a bypass outlet port in continuous communication with the fuel supply and the outlet of said bypass valve.

5. The fuel delivery system of claim 3 wherein said bypass valve comprises a bypass valve actuating stem extending from a sealing portion of said valve disposed in said first chamber through an opening in said diaphragm into said second chamber.

6. The fuel delivery system of claim 5 comprising a spring retainer on a free end of said valve stem in said second chamber and a spring surrounding said valve stem and received between said stem spring retainer and said diaphragm to yieldably bias the bypass valve closed.

7. The fuel delivery system of claim 6 wherein said valve stem abuts said housing when said diaphragm is displaced in said second chamber as said first chamber reaches its maximum volume.

8. The fuel delivery system of claim 7 comprising an electric switch cooperable with said bypass valve stem and pump and operable to eliminate or reduce fuel flow from said pump to said first chamber to thereby eliminate or reduce bypass flow into said second chamber.

9. The fuel delivery system of claim 8 wherein said switch controls said pump to vary the amount of fuel supplied by said pump inversely relative to first chamber volume.

10. The fuel delivery system of claim 9 wherein said switch comprises an electrically conductive rod encased in an electrical insulator screw mounted in an opening in said housing, said rod having a contact on one end disposed in said second chamber for circuit closing engagement with said valve and electrically connected to said pump, said valve being electrically energized through electrically conductive structure of said housing so that when said expansion chamber expands to its maximum volume said valve contacts the metal rod to close the electric circuit to generate an electrical control signal causing said pump to reduce its fuel output, and vice versa.

11. The fuel delivery system of claim 2 which also comprises a pressure relief bypass passage communicating with said outlet upstream of said check valve.

12. An accumulator for an automotive fuel delivery system for an engine having an air intake manifold and at least one fuel injector operably associated therewith and a fuel pump for supplying tank fuel to the injector, said accumulator comprising a housing, a flexible diaphragm defining in cooperation with said housing first and second chambers impermeably separated by said diaphragm, said diaphragm having a circumferentially continuous annular pleat portion surrounding a central portion of the diaphragm and sized to permit by gathering and ungathering thereof a predetermined full working travel of said diaphragm central portion in said chambers within said pleat portion, a biasing means in said second chamber and yieldably biasing said diaphragm to resist that working travel of said diaphragm decreasing the volume of said second chamber, said housing having a reference port on one side of said diaphragm adapted for continuously communicating a source of reference air pressure related to operation of the engine with said second chamber for controlling the biasing force of said biasing means on said diaphragm, said housing having a fuel passage on the opposite side of said diaphragm having an inlet to said first chamber adapted for continuously communicating said first chamber with the fuel delivery system such that any volumetric increase in the fuel in the system between the fuel injector and said fuel passage inlet is accommodated within limits by that working travel of said diaphragm causing expansion of said first chamber against the biasing force of said biasing means, and wherein said diaphragm has a fuel delivery system bypass valve carried by said diaphragm and movable relative to said diaphragm to open and closed positions when diaphragm travel communicates fuel between said first chamber and said second chamber for relieving system pressure above a predetermined maximum set point.

13. The accumulator set forth in claim 12 wherein said housing has a bypass outlet port adapted for continuously communicating the fuel supply and the outlet of said bypass valve.

14. The accumulator set forth in claim 12 wherein said bypass valve comprises a bypass valve actuating stem extending from a sealing portion of said valve disposed in said first chamber through an opening in said diaphragm into said second chamber.

15. The accumulator set forth in claim 14 and further comprising a spring retainer on a free end of said valve stem in said second chamber and a spring surrounding said valve stem and received between said stem spring retainer and said diaphragm to yieldably bias the bypass valve closed.

16. The accumulator set forth in claim 15 wherein said valve stem abuts said housing when said diaphragm is displaced in said second chamber as said first chamber reaches its maximum volume.

17. The accumulator set forth in claim 16 and further comprising an electric switch adapted to cooperate with said bypass valve stem and the pump to eliminate or reduce fuel flow from the pump to said first chamber to thereby eliminate or reduce bypass flow into said second chamber.

18. The accumulator set forth in claim 17 wherein said switch is adapted to control the pump to vary the amount of fuel supplied by the pump inversely relative to first chamber volume.

19. The accumulator set forth in claim 18 wherein said switch comprises an electrically conductive rod encased in an electrical insulator screw mounted in an opening in said housing, said rod having a contact on one end disposed in said second chamber for circuit closing engagement with said valve and electrically connected to the pump, said valve being adapted to be electrically energized through electrically conductive structure of said housing so that when said expansion chamber expands to its maximum volume said valve contacts the metal rod to close the electric circuit to generate an electrical control signal causing the pump to reduce its fuel output, and vice versa.

20. The accumulator set forth in claim 12 wherein said biasing means comprises a second spring disposed in said second chamber and acting between housing and said central portion of said diaphragm for yieldably resisting ensmalling of said second chamber by fuel accumulation in said first chamber, and wherein said housing has a reference port communicating with said second chamber adapted for continuously communicating a source of reference air pressure related to operation of the engine with said second chamber for controlling the biasing force of said second spring acting on said diaphragm.

21. The accumulator set forth in claim 20 wherein said housing has a bypass outlet port adapted for continuously communicating the fuel supply and the outlet of said bypass valve.

22. The accumulator set forth in claim 21 wherein said bypass valve comprises a bypass valve actuating stem extending from a sealing portion of said valve disposed in said first chamber through an opening in said diaphragm into said second chamber.

23. The accumulator set forth in claim 22 further comprising a spring retainer on a free end of said valve stem in said second chamber and a spring surrounding said valve stem and received between said stem spring retainer and said diaphragm to yieldably bias the bypass valve closed.

24. The accumulator set forth in claim 23 wherein said valve stem abuts said housing when said diaphragm is displaced in said second chamber as said first chamber reaches its maximum volume.

25. The accumulator set forth in claim 24 further comprising an electric switch adapted to cooperate with said bypass valve stem and the pump and operable to eliminate or reduce fuel flow from the pump to said first chamber to thereby eliminate or reduce bypass flow into said second chamber.

26. The accumulator set forth in claim 25 wherein said switch is adapted to control the pump to vary the amount of fuel supplied by the pump inversely relative to first chamber volume.

27. The accumulator set forth in claim 26 wherein said switch comprises an electrically conductive rod encased in an electrical insulator screw mounted in an opening in said housing, said rod having a contact on one end disposed in said second chamber for circuit closing engagement with said valve and electrically connected to the pump, said valve being adapted to be electrically energized through electrically conductive structure of said housing so that when said expansion chamber expands to its maximum volume said valve contacts the metal rod to close the electric circuit to generate an electrical control signal causing the pump to reduce its fuel output, and vice versa.

* * * * *